US008037802B2

(12) United States Patent
Ciriscioli et al.

(10) Patent No.: US 8,037,802 B2
(45) Date of Patent: Oct. 18, 2011

(54) ARMORED WINDOW SYSTEM

(75) Inventors: Peter R. Ciriscioli, Benicia, CA (US); James R. Turner, Campbell, CA (US); Matthew G. Riddle, Saratoga, CA (US); Brendan P. Croom, San Jose, CA (US); Daniel J. Richard, San Jose, CA (US); John C. Turn, Jr., San Jose, CA (US)

(73) Assignee: BAE Systems Land & Armaments, L.P., Santa Clara, CA (US)

( * ) Notice: Subject to any disclaimer, the term of this patent is extended or adjusted under 35 U.S.C. 154(b) by 171 days.

(21) Appl. No.: 12/247,683

(22) Filed: Oct. 8, 2008

(65) Prior Publication Data

US 2011/0226122 A1 Sep. 22, 2011

Related U.S. Application Data

(60) Provisional application No. 60/978,270, filed on Oct. 8, 2007.

(51) Int. Cl.
*F41H 5/00* (2006.01)

(52) U.S. Cl. ..... 89/36.01; 89/36.04; 89/36.07; 89/36.14; 109/58; 109/78

(58) Field of Classification Search ..... 89/36.01, 89/36.04, 36.07, 36.14; 109/58, 78
See application file for complete search history.

(56) References Cited

U.S. PATENT DOCUMENTS

| | | | | |
|---|---|---|---|---|
| 1,859,013 | A * | 5/1932 | Wise | 109/21.5 |
| 4,005,662 | A * | 2/1977 | Kohn et al. | 109/16 |
| 4,355,676 | A * | 10/1982 | Lee | 160/107 |
| 5,452,641 | A * | 9/1995 | Kariya | 89/36.14 |
| 6,672,195 | B1 * | 1/2004 | Plattner | 89/36.11 |
| 7,225,718 | B1 * | 6/2007 | Grove et al. | 89/36.09 |
| 2010/0043292 | A1 * | 2/2010 | Wilkins | 49/64 |
| 2010/0139874 | A1 * | 6/2010 | Sudano et al. | 160/236 |

FOREIGN PATENT DOCUMENTS

JP 2000257347 9/2000

OTHER PUBLICATIONS

International Application No. PCT/US2008/079191 dated Mar. 25, 2009.
Written Opinion for International Application No: PCT/US2008/079191 dated Mar. 25, 2009.

* cited by examiner

*Primary Examiner* — Michael Carone
*Assistant Examiner* — Samir Abdosh
(74) *Attorney, Agent, or Firm* — Patterson Thuente Christensen Pedersen, P.A.

(57) ABSTRACT

An improved transparent armor piercing protection system that acts as a vision window in an armor system. The transparent armor piercing protection system comprises ballistic plastic prisms with mirrored external surfaces disposed between armor plates so that the reflection of the image occurs entirely within the prism. The armor sheets are also redesigned with perforations to reduce weight while defeating incoming threats.

10 Claims, 6 Drawing Sheets

ARMORED WINDOW SYSTEM

RELATED APPLICATION

The present application claims the benefit of U.S. Provisional Application No. 60/978,270 filed Oct. 8, 2007, which is incorporated herein in its entirety by reference.

FIELD OF THE INVENTION

The invention relates to a vehicle window, and more specifically, to an armored window system that includes the use of ballistic prisms mounted between opposing armor plates within a sealed frame for defeating incoming threats while maintaining the occupants' safety.

BACKGROUND OF THE INVENTION

Situational awareness is a vitally important element of battlefield survival. Nothing improves this awareness as well as clear, direct vision. However, this usually means the viewer, who is otherwise safely housed within an armored vehicle, for example, must be exposed to enemy ballistic and blast threats in order to have a view of the outside world. The dilemma of providing protection while permitting a clear view has been addressed in the past by providing an "armored window" in the vehicle. One common form of prior art armored window includes a frame spanned by a plurality of horizontal steel armor plates, which are vertically overlapping and spaced apart, with the inner and outer surfaces of each plate coated with a reflective material to form a short periscope. In other words, the viewer does not see an image directly, but instead sees the image reflected twice, once off the outer surface of one plate and then the inner surface of the plate immediately above it. This type of armored window has been used in armored personnel carriers, such as the Bradley Fighting Vehicle, and is called the TRAPP (Transparent-Armor Piercing Protection) Armor System, the design of which is disclosed in U.S. Pat. No. 5,452,641.

The TRAPP Armor System is an arrangement of front cover plate, back plate or "catcher," a plurality of angularly mounted parallel steel plates separated by an air space and a frame that holds the assembly together. The facing sides of the parallel plates are ground, polished and plated to achieve a mirror finish. When an image is viewed through the arrangement of plates, it is reflected twice and is seen erect and slightly offset as through a periscope.

The use of mirrored armor plates has a number of inherent drawbacks. The prior art armored window requires a reflective coating to be applied to the steel armor plates themselves. The application of such a coating is achieved by laminating a mirrored layer to each side of the armor plates, a process both difficult and expensive. Once the lamination is achieved, any separation between the plate and the mirrored layer, such as the formation of bubbles created by differential expansion rates due to heat extremes encountered in the field, will cause distortion of the image. Unless the mirrored surfaces are optically perfect, unacceptable distortions are introduced. Achieving this mirror finish is difficult, expensive, and hard to maintain on the steel plates.

While the system protects the occupants, the system is fragile. When fragments from bursting artillery rounds or small arms projectiles (bullets) strike the TRAPP system, the lines of flight are altered by the steel plates. The alterations in the line of flight can be dramatic enough to cause the fragment or bullet to impact two or more plates. The plate impacts tend to shatter the fragments and bullets and absorb their energy.

Eventually the fragments and projectiles, with reduced residual energy, impact the backing plate where they are captured. As alignment of the plates is critical, these forces tend to skew a plate which reduces visibility and may open a path for later bullets or fragments. Thus the prior art design limits the ballistic protection to relatively low levels.

In the prior art, the space between plates provides no benefit and complicates the design because it requires the system to be hermetically sealed to prevent the free exchange of air laden with dust and moisture that will diminish the reflectivity of the plate surfaces. The reflective surfaces on the steel plates are difficult and expensive to apply, and are often subject to separation which causes image distortion. Moreover, the frame requires precision machining and is thus expensive to manufacture. The plates must be affixed within the frame so as to be parallel to each other in three dimensions in order for the reflected image to accurately represent what is outside the vehicle. Thus there is a need to overcome the deficiencies of the present armor system, to simplify and reduce the cost of construction, to increase ballistic performance, to improve the optics, to improve reliability, and to eliminate the need for hermetically sealing the system.

SUMMARY OF THE INVENTION

The present invention is an armored window system that utilizes ballistic prisms coated with mirrored reflective surfaces disposed between armored plates. The prisms are the sole means of transmitting the image, i.e., the reflections occur within the prisms themselves. Thus, the armored steel plates are removed from any involvement in the transmission of the image, which allows such plates to perform only their primary function of defeating the incoming threat. Since the plates are not required for image transmission, it is no longer necessary for the plates to have a solid surface. Thus the armored plates are preferably provided with a plurality of holes, which improves their ability to defeat incoming threats while simultaneously reducing weight and thereby contributing to the overall mobility of the vehicle. The prisms are made separately and individually, i.e., each is formed to shape with correctly aligned sides and then coated to form mirrored interior surfaces, which surfaces are unaffected by the accumulation of dust and dirt.

The armored window system provides for perforated steel plates with un-plated surfaces. Ballistic plastic prisms are manufactured with the required reflective surfaces. The prisms are arranged between the plates. The benefits of this improvement include: costs for preparing the plates for a reflective coating are avoided, elimination of the free airspace within the volume of the system, the ballistic property of the plates is improved, and the frame is simplified. System assembly is easier because the plates and prisms align themselves in a sub-assembly. Survivability of the system is increased as shattered and deflected fragments from projectiles must penetrate the prisms before striking additional plates and/or impacting the back plate.

The present invention provides an optional viewing device for use on armored combat vehicles, to include, but not limited to tactical trucks, tanks, personnel carriers, landing vehicles, air cushion vehicles, construction equipment, combat engineering equipment, railroad locomotives, police vehicles, ships and submarines.

DETAILED DESCRIPTION OF THE DRAWINGS

Figure 1:
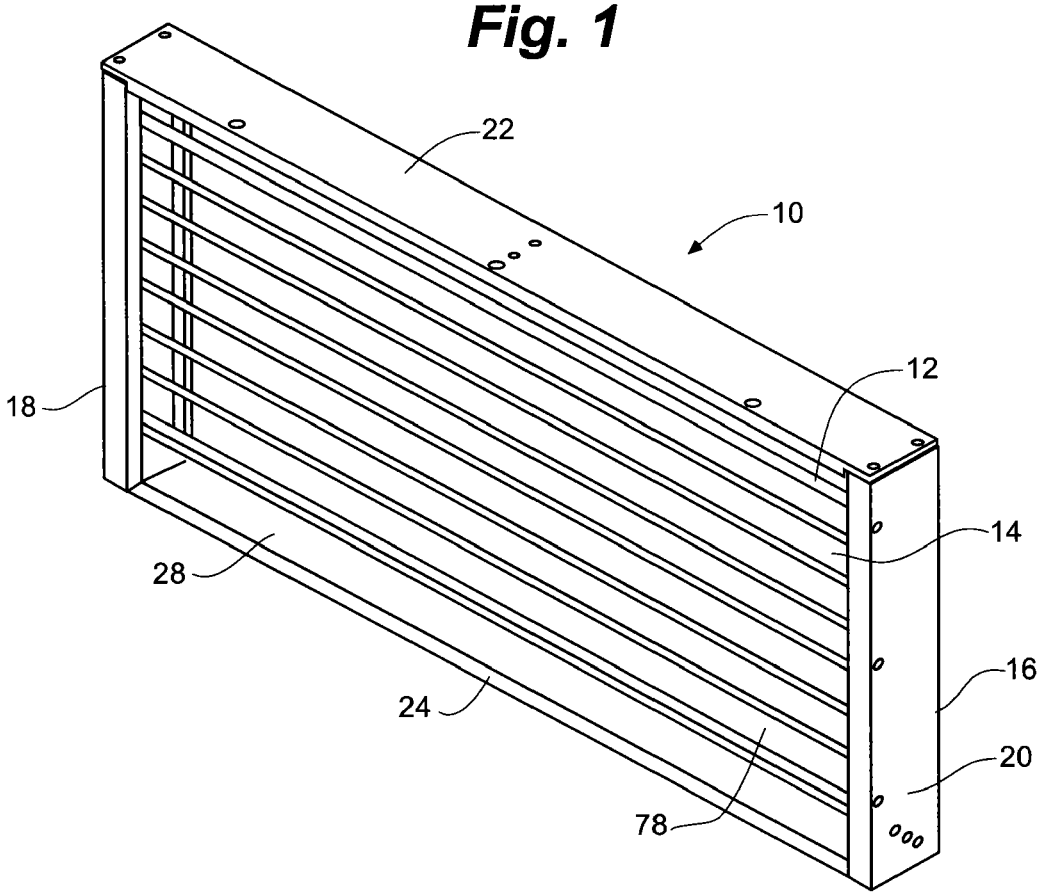
FIG. 1 is a perspective view of the armored window assembly of the present invention.

A first embodiment of the present invention is illustrated in FIGS. 1-6. The armored window system 10 comprises a plurality of multiple ballistic louvers 12 and prism windows 14 mounted within a frame 16. The multiple ballistic louvers 12 and prism windows 14 together form the armored pane 78. The frame 16 includes left vertical edge 18, right vertical edge 20, upper horizontal frame member 22, and lower horizontal frame member 24. A strike plate 26 is disposed about one face of the frame 16 with a transparent polycarbonate plate 28 on the opposing face. The left vertical edge 18, right vertical edge 20 both contain an interior channel 80. The interior channel 80 includes an angled base 84 that sets for supporting the armored pane 78.

Figure 2:
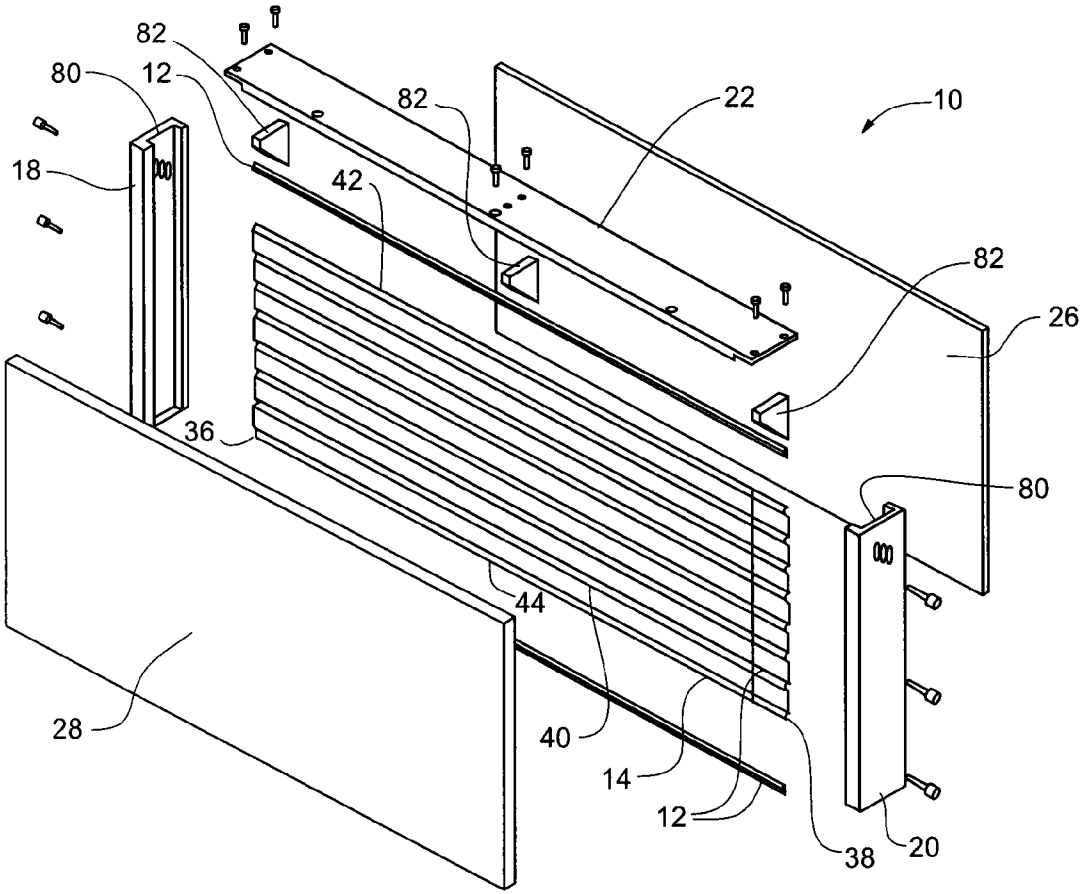
FIG. 2 is an exploded view of the armored window assembly of the present invention.
Figure 4:
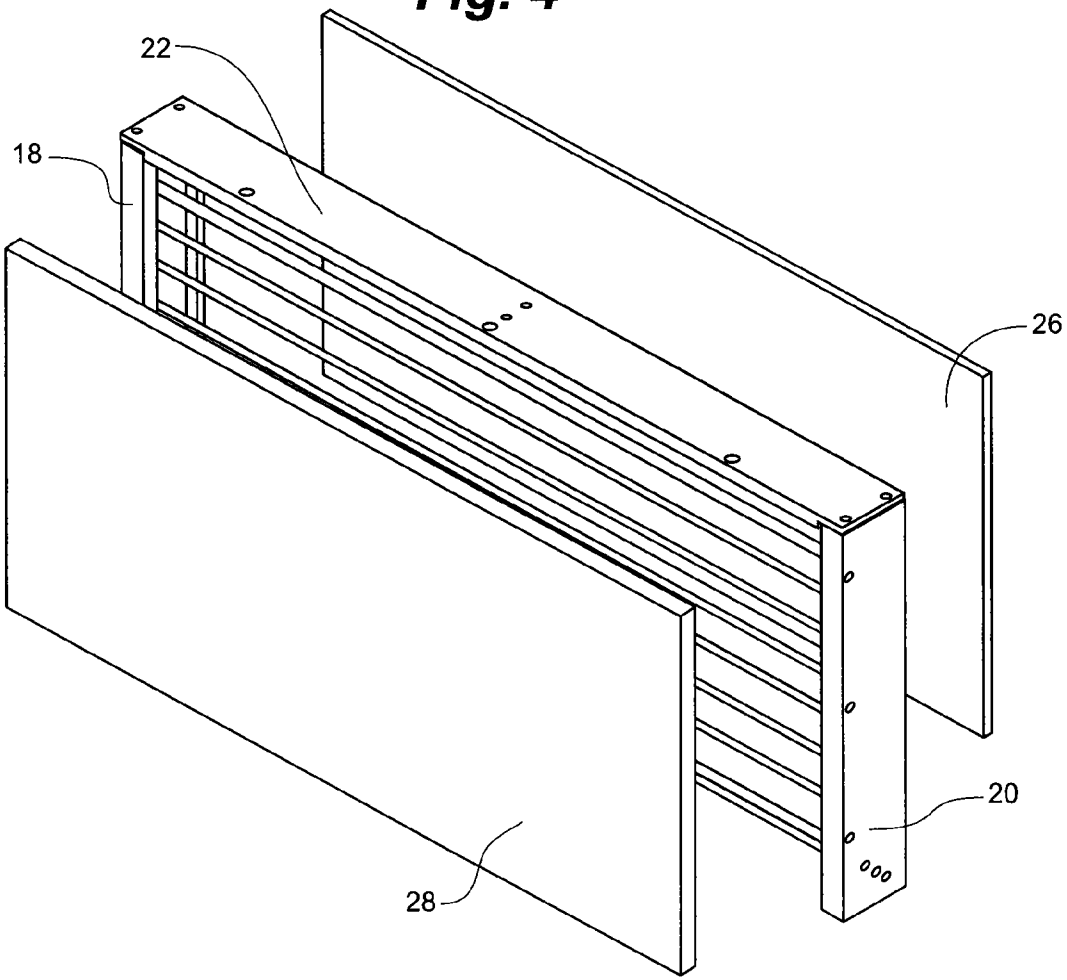
FIG. 4 is an assembly drawing of the strike plate and polycarbonate plate of the armored window assembly of the present invention.

A plurality of louvers 12 extend from the first side edge 36 to the second side edge 38. The louvers 12 are spaced apart from each other by prism windows 14 and are parallel to each other as shown in FIGS. 1 and 2. Each louver 12 has a length 40. The louvers 12 and prism windows 14 are stacked from the top side edge 42 to the bottom side edge 44. A plurality of angled pushers 82 are disposed between the upper horizontal frame 22 and in contact with the top side edge 42. The angled pusher 82 angles the louvers 12 and prism windows 14 relative to the frame 16. The bottom side edge 44 rests on the angled base 84 of interior channel 80.

Each louver 12 and prism window 14 in addition has a first edge 46 and a second edge 48. The first edge 46 of a louver 12 overlaps with a second edge 48 of an adjacent louver 12 by a sufficient amount so as to not allow direct passage of an image without contact with a louver 12. When bonded together, the louvers 12 and prism windows 14 form armored pane 78.

Figure 3:
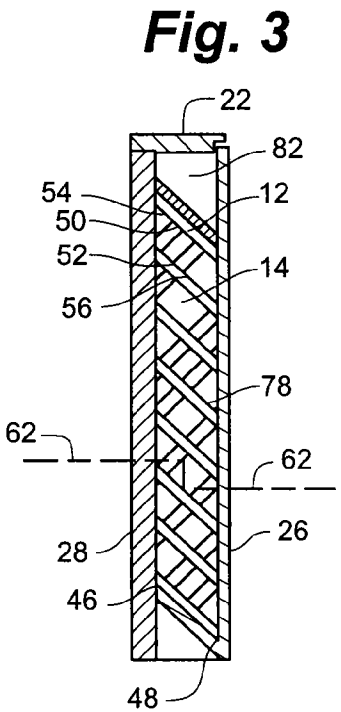
FIG. 3 is a cross sectional drawing of the armored window assembly of the present invention.

FIG. 3 is a view of part of a cross-section of invention 10. A louver 12 is placed between prism windows 14. The louver 12 is formed by an armor slat, which is strong enough to shatter desired armor piercing projectiles. The louver 12 may be either a solid face or perforated to provide additional visibility to the operator without compromising safety. As the louver 12 does not contribute to the vision aspects of the window the perforations can be sized and spaced according to the likely threat. The prism window 14 has a first surface 50 and a second surface 52. The first surface 50 of the prism window 14 has a first reflective coating 54, which provides a first optical quality reflective (mirror) surface. The second surface 52 of the prism window 14 has a second reflective coating 56, which provides a second optical quality reflective (mirror) surface. In a first embodiment the reflective coating 54, 56 may be an aluminum coating with a silicon oxide finish.

The polycarbonate plate 28 is a sheet of transparent material placed spaced a part from the louvers 12 and is supported by the left vertical edge 18, right vertical edge 20, upper horizontal frame member 22, and lower horizontal frame member 24. In an embodiment, the sheet of transparent material 28 is a glass/plastic laminate. The sheet of transparent material could be any conventional transparent armor, such as Makrolon® which is ballistically adequate to contain spallation from specified threat levels.

Figure 5:
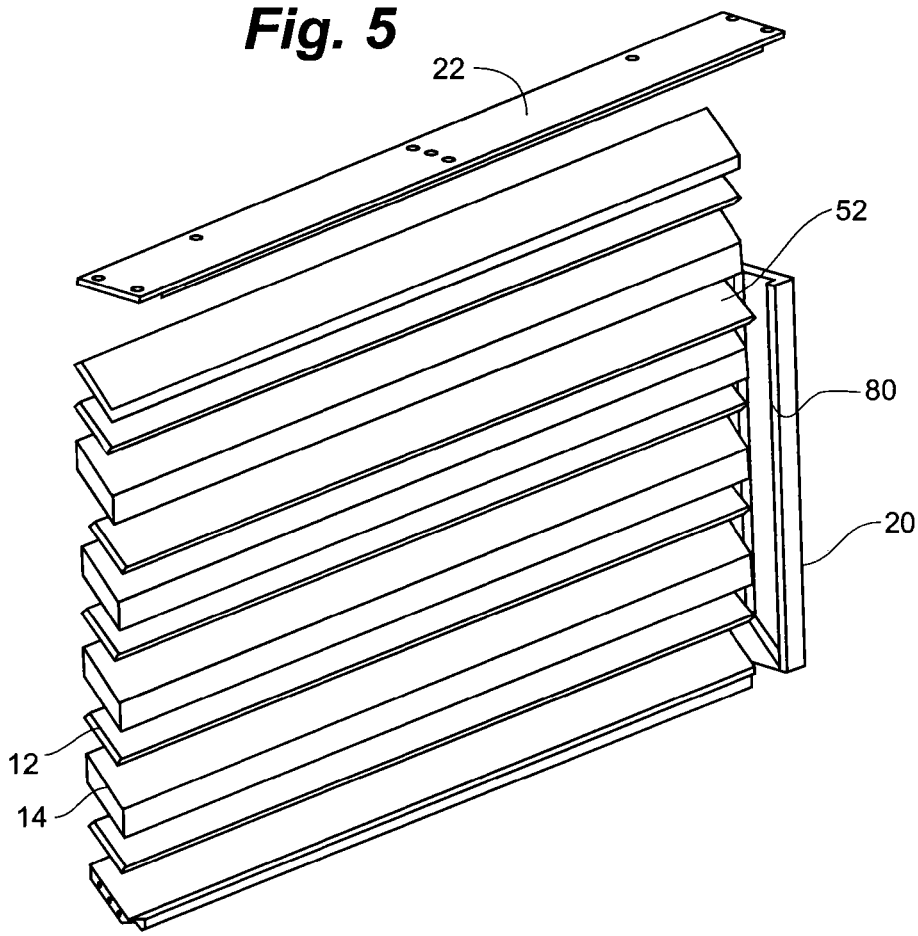
FIG. 5 is an assembly drawing of the prism section of the armored window assembly of the present invention.
Figure 6:
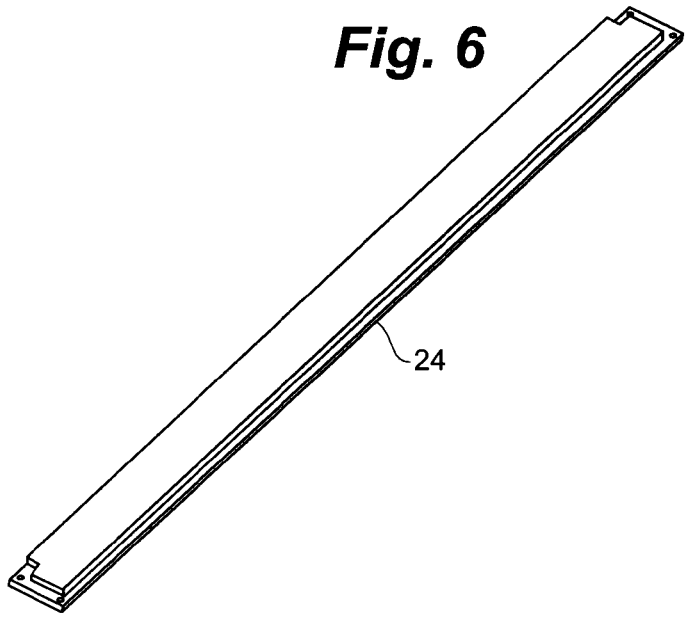
FIG. 6 is a perspective view of the horizontal frame element of the armored window assembly of the present invention.
Figure 7:
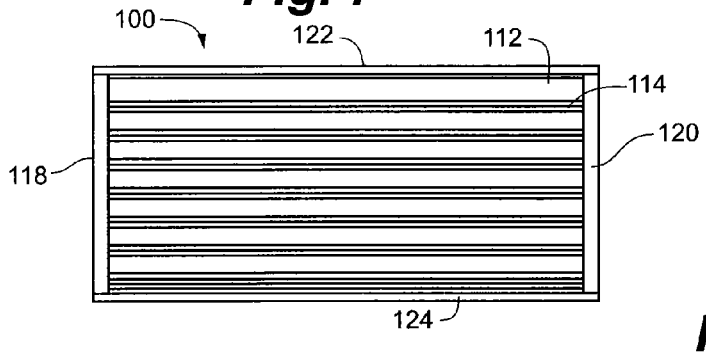
FIG. 7 is a front elevation of an alternate embodiment of the armored window assembly of the present invention.
Figure 8:
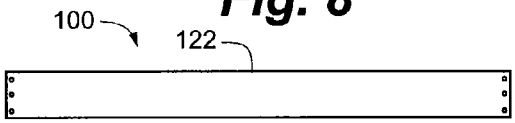
FIG. 8 is a top elevation of an alternate embodiment of the armored window assembly of the present invention.
Figure 9:
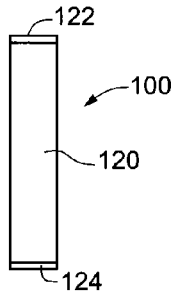
FIG. 9 is a side elevation of an alternate embodiment of the armored window assembly of the present invention.
Figure 10:
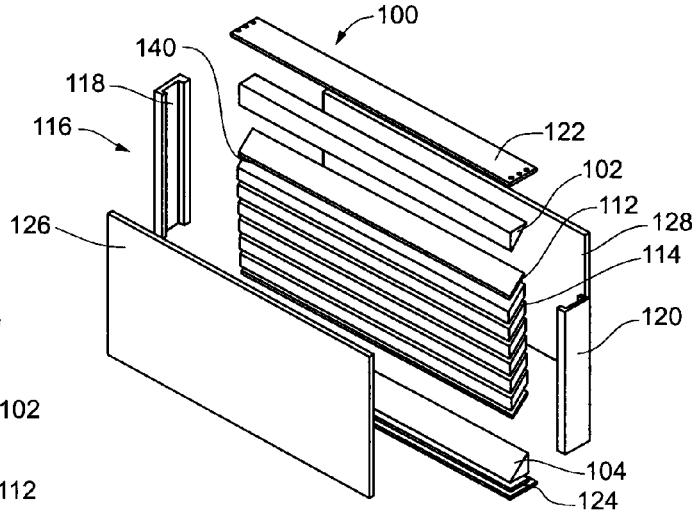
FIG. 10 is an exploded view of an alternate embodiment of the armored window assembly of the present invention.
Figure 11:
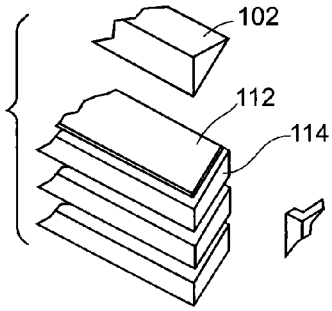
FIG. 11 is detail view of Area A as noted in FIG. 10.
Figure 12:
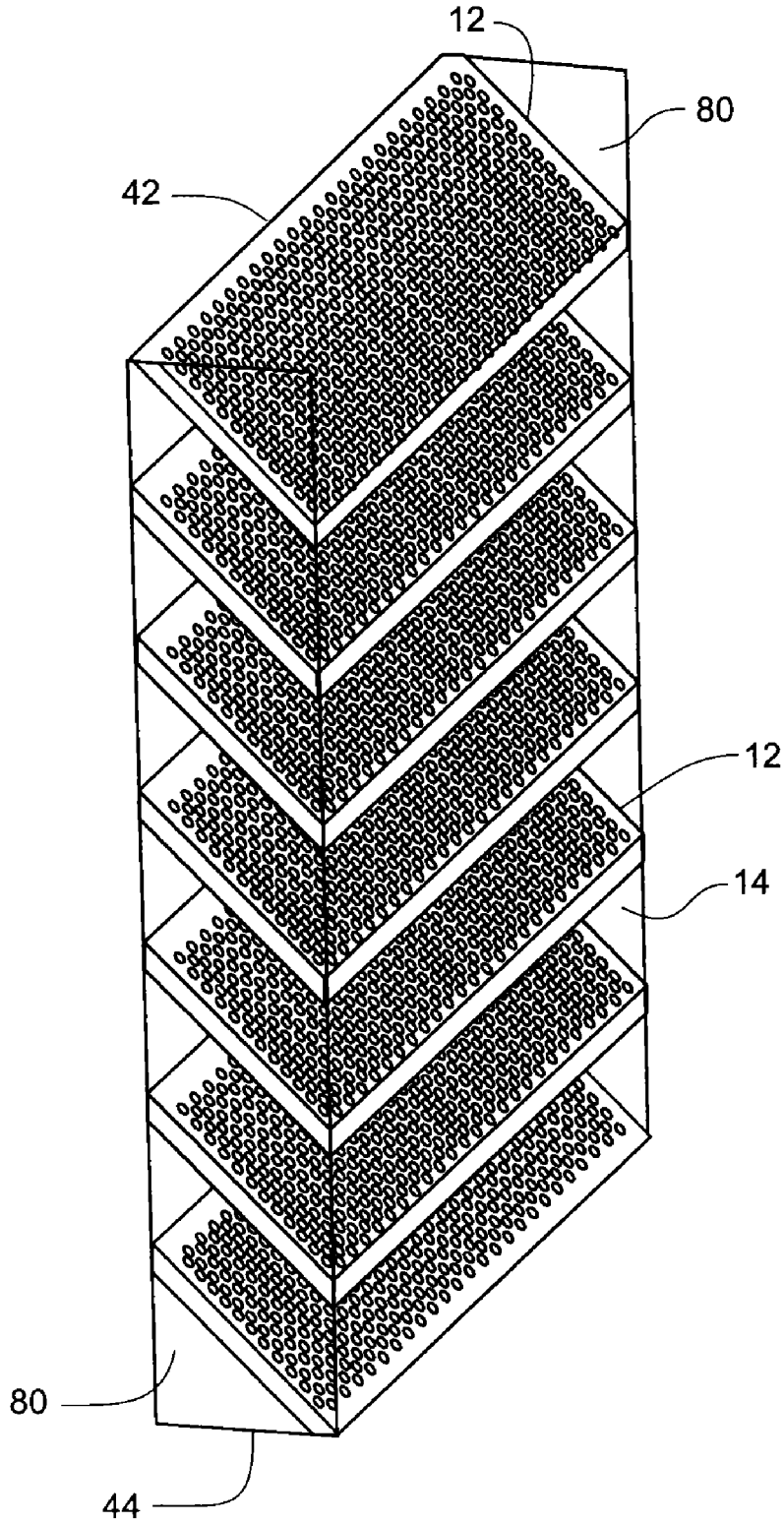
FIG. 12 is a perspective view of the armored pane embodiment with perforated plates.

The armored pane 78 forms a solid insert comprised of alternating layers of prism 14 and louver 12. It is envisioned that an adhesive, such as a silicone adhesive sealant would be applied to join the prisms 14 to the louvers 12 as well as fill all gaps between the frame 16 and the pane 78. As illustrated in FIG. 3, the prism 14 includes vertical faces 85 that abut the inner face of plate 28 and strike plate 26. The louvers 12 in this embodiment do not have a vertical end face. Louver 12 has a rectangular end face 86 so that the louver does not interrupt the line of sight. FIG. 12 illustrates the armored pane 78 in which the louvers 12 contain perforations and vertical end faces. In addition, partial prisms 90 are disposed at the top edge 42 and bottom edge 44. The partial prisms 90 may not be required if the frame 16 includes a channel 80 as depicted in FIG. 5.

In the operation of the invention, a vehicle operator is protected by the conventional armor which supports the armored window system 10, forming a window allowing the operator to see outside of the vehicle. Line of sight lines 62 indicate how light enter the prism 14 horizontally through plate 26 and then strike the first reflective coating 54. The light 62 is reflected approximately forty-five degrees to strike the second reflective coating 56 on the opposite face of the same prism window 14. The light is then reflected approximately forty-five degrees back to horizontal and through the plate 28, thus completing the path between the outside of the vehicle and the operator. The light path 62 thus is completely free of the armored louvers 12. Because the prism windows 14 provide a reflected beam of light that is parallel to the incident beam of light, the prism windows 14 allow the operator to have an undistorted view of the outside, through the inventive transparent armor. If a projectile is directed at the inventive transparent armor 10, the projectile will strike the louvers 12 which will either stop the projectile or cause it to fragment and/or destabilize. The remaining fragments of the projectile will be stopped by the strike plate 26. The louvers 12 are angled so that in order for a projectile to be angled so that it may not encounter the louvers 12, the projectile would need to come from a location very close to the vehicle, so that such a flight path would be highly improbable.

FIGS. 7-11 are illustrations of another embodiment of the invention 100. The alternative embodiment 100 similarly comprises a plurality of multiple ballistic louvers 112 and prism windows 114 mounted within a frame 116. The alternative embodiment frame 116 includes a left vertical edge 118, a right vertical edge 120, upper horizontal frame member 122, and a lower horizontal frame member 124. In this embodiment a lower angled pusher 102 is disposed on the upper horizontal frame member 122 extending the length 140 of the louvers 112. A lower angled pusher 104 is disposed on the lower horizontal frame member 124, also extending the length 140 of the louvers 112. The upper and lower angled pushers 102, 104 maintain relative angled position of the louvers 112 and prism windows 114 within the frame 116.

Although the best mode contemplated for carrying out the present invention has been herein shown and described, it will be understood that modification and variation may be made without departing from what is regarded to be the subject matter of the invention. For instance, the angle of the ballistic prisms relative to the frame may be changed due to the slope of the armored window in the host vehicle.

What is claimed is:

1. An armored window system comprising:

a window frame;

an armored pane disposed within the window frame, wherein said armored pane includes alternating layers of uncoated armored plate and ballistic prisms, said ballistic prisms sized to fill the space between the armored plate so as to eliminate free space within the armored pane;

a transparent plate disposed adjacent to the window frame; and a transparent strike plate disposed adjacent to the window frame opposite the transparent plate.

2. The system of claim 1 wherein the armored plates are provided with perforations to reduce weight and improve their ability to defeat the incoming threat.

3. The system of claim 1 wherein the ballistic prism is a rectangular bar having opposing parallel sides and opposing end faces, the end faces having a trapezoidal shape.

4. The system of claim 3 wherein opposing faces of the ballistic prism are coated with a reflective material.

5. The system of claim 4 wherein the coating includes aluminum with a silicon oxide finish.

6. The system of claim 1 wherein the armored plate is arranged as an angled louver within the armored pane so as to intercept any horizontal plane passing through the armored pane.

7. The system of claim 6 wherein the angled louvers overlap with each other.

8. The system of claim 1 wherein the ballistic prisms are aligned at 45 degrees relative to a horizontal plane passing through the window.

9. The system of claim 1 wherein the armored pane is sealed within the frame using an adhesive.

10. The system of claim 1 wherein the transparent plate and the transparent strike plate are sealed within the frame using an adhesive.

* * * * *